United States Patent [19]

Kishimoto et al.

[11] Patent Number: 4,563,031

[45] Date of Patent: Jan. 7, 1986

[54] TUBE HANDLING DEVICE

[75] Inventors: Takashi Kishimoto, Kawanishi; Kensaku Shimizu, Miki; Yukito Nagai, Akashi, all of Japan

[73] Assignee: Kawasaki Jukogyo Kabushiki Kaisha, Japan

[21] Appl. No.: 652,114

[22] Filed: Sep. 19, 1984

[30] Foreign Application Priority Data

Sep. 21, 1983 [JP] Japan ..... 58-176046

[51] Int. Cl.[4] ..... B66C 1/28

[52] U.S. Cl. ..... 294/81.21; 294/81.51; 294/81.54; 294/87.1; 294/907

[58] Field of Search ..... 294/67.3, 67.31, 67.33, 294/81.1–81.21, 81.51, 81.54, 81.56, 81.61, 81.62, 87.1, 119.1, 902, 907

[56] References Cited

U.S. PATENT DOCUMENTS

| | | | |
|---|---|---|---|
| 1,834,499 | 12/1931 | Richter | 294/81.51 X |
| 2,429,193 | 10/1947 | Pool et al. | 294/87.1 |
| 2,718,320 | 9/1955 | Nelson et al. | 294/67.33 X |
| 3,688,933 | 9/1972 | Rumell | 294/81.21 X |
| 3,727,965 | 4/1973 | Cranston et al. | 294/81.54 |
| 3,827,743 | 8/1974 | Visser | 294/81.21 |

*Primary Examiner*—Johnny D. Cherry

*Attorney, Agent, or Firm*—Leydig, Voit & Mayer, Ltd.

[57] ABSTRACT

A tube handling device of a type in which a plurality of tubes are hung by inserting claws in opposite end portion of the tubes, including a telescopically movable beam supporting at opposite ends thereof a plurality of claw members for movement in a direction perpendicular to the length of the beam, and sensor members for sensing the vertical distance between the tubes and the tube handling device and the horizontal distance between the claw members and the end edges of the tubes.

2 Claims, 10 Drawing Figures

TUBE HANDLING DEVICE

FIELD OF THE INVENTION

This invention relates to a tube handling device suitable for use in loading and unloading tubular goods.

DESCRIPTION OF THE PRIOR ART

Figure 1:
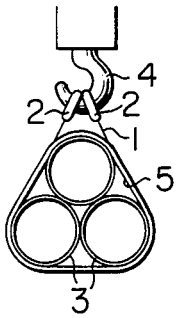
FIG. 1 PRIOR ART
FIG. 1 is a front view of a tube handling device of the prior art relying on a wire for holding a plurality of tubular goods together.
Figure 2:
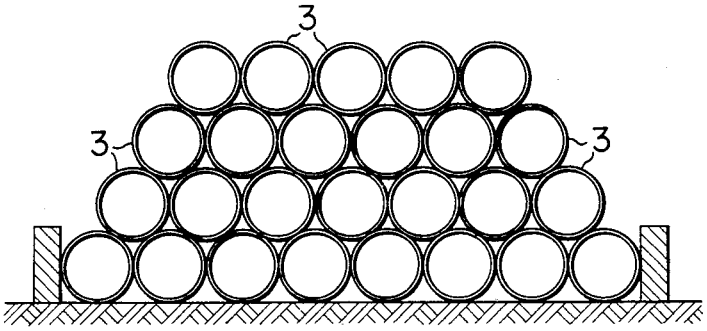
FIG. 2 is a front view of a yard for stacking tubular goods therein.

Tube handling devices of the prior art will be outlined before describing the tube handling device according to the invention. One type of tube handling device of the prior art relies on a wire for holding a plurality of tubes together, as shown in FIG. 1. In this type of tube handling device, the tube bundling operator passes a wire 1 around tubes 3 stacked in a yard in a plurality of layers as shown in FIG. 2, after a gap is formed between the tubes 1. Then, thimbles 2 are hung from a hook 4 as of a winch, as shown in FIG. 1, to perform a tube loading operation. When necessary, a protector 5 is provided to prevent the wire 1 from being brought into contact with the tubes 3. To wind the wire 1 manually around the tubes 3, it is essential that the tubes 1 be stacked in an orderly manner in the yard and the stack of tubes 3 be relatively small in height while the tubes 3 are kept in contact with each other, for the safety of the operator. Thus, the yard in which the tubes 3 are stacked has hitherto required a large area.

Figure 3:
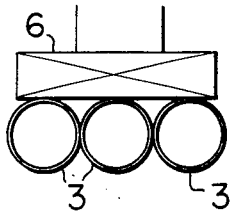
FIG. 3 PRIOR ART
FIG. 3 is a front view of a tube handling device of the prior art relying on an electromagnet for holding a plurality of tubular goods together.

FIG. 3 shows another type of tube handling device of the prior art which uses an electromagnet 6 for attracting the tubes 3 together. This tube handling device requires a strong electromagnetic force, and this raises the problem that the steel tubes handled would be magnetized and residual magnetism might adversely affect the tubes. This device is inoperable when the power supply is cut, and there is the danger that the steel tubes being hung might be released and drop if the power supply were cut during a loading or unloading operation. The most important defect is that this type of tube handling device is unable to handle nonferrous tubular goods.

Figure 4:
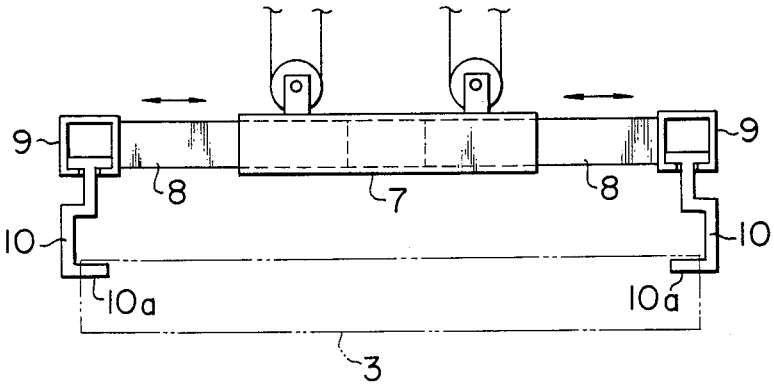
FIG. 4 PRIOR ART
FIG. 4 is a side view of a tube handling device of the prior art of a claw insertion type.
Figure 5:
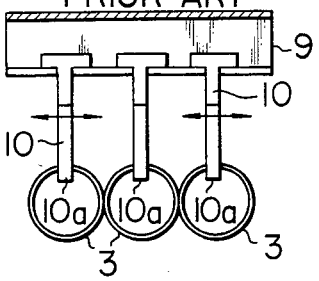
FIG. 5 PRIOR ART
FIG. 5 is a front view of the tube handling device shown in FIG. 4.
Figure 7:
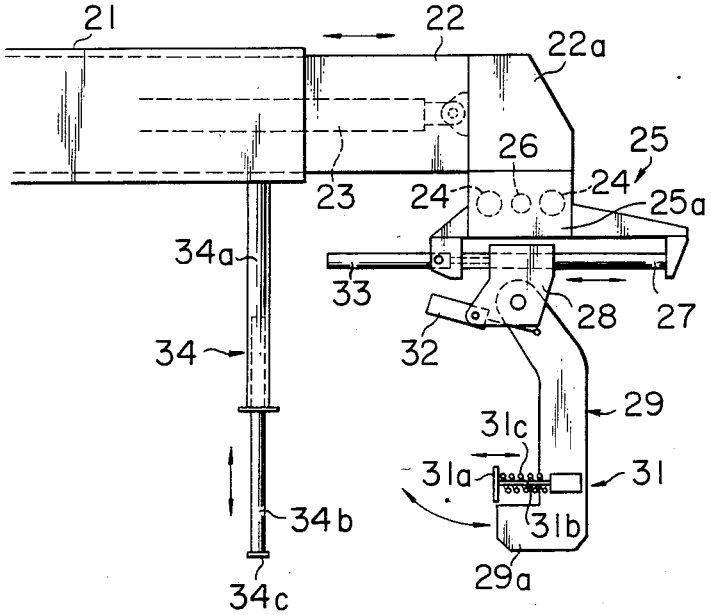
FIG. 7 is a side view of the essential portions of the tube handling device shown in FIG. 6.
Figure 8:
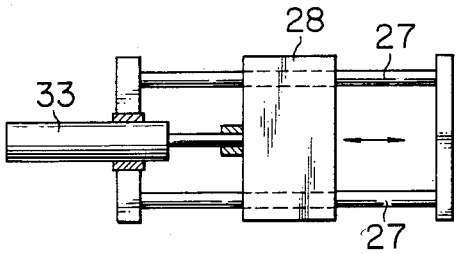
FIG. 8 is a plan view of the claw member section.
Figure 6:
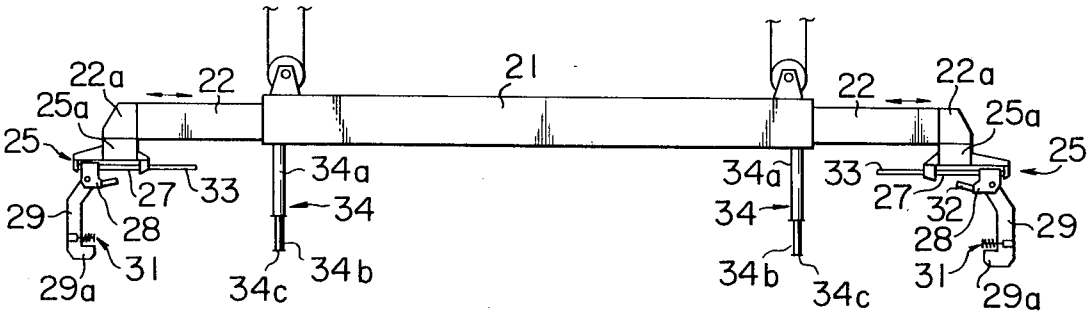
FIG. 6 is a side view of the tube handling device comprising one embodiment of the invention.

Still another type of tube handling device of the prior art will be outlined by referring to FIGS. 4 and 5. This device comprises a first beam 7 extending horizontally, a plurality of second beams 8 each located at either end of the first beam 7 for sliding movement axially of the first beam 7, and a plurality of claw means 9 each connected to one side of the second beams 8 and extending downwardly therefrom at right angles. The claw means 9 are each in the form of a channel and include a plurality of claws 10 movably hung from the claw means 9 of the channel shape and each being formed at a lower end thereof with an inwardly directed engaging portion 10*a*. In operation, the second beams 8 are moved outwardly with respect to the first beam 7, and the claws 10 are brought into index with end portions of the tubes 3 to be handled. Then, the second beams 8 are moved inwardly with respect to the first beam 7 to insert the engaging portions 10*a* in the end portions of the tubes 3 to engage same, to perform a loading or unloading operation. This device has suffered the disadvantage that it is only the tubes of the same length that can be handled. Stated differently, this device has raised the problem that it is necessary to select tubes of the same length each time the tubes are handled. Another disadvantage of this device is that, although the claws 10 are movable along the claw means 9 at right angles to the first beam 7, they are stationary lengthwise of the first beam 7 and it is necessary, when the stack of tubes to be handled includes tubes that should be left in the yard without being handled, to manually remove such tubes or claws. This requires an operation that might cause danger to the operator. An additional problem is that an operator responsible for avoiding damage that might be caused on the tubes by the claws as the latter are inserted in the former is additionally required for performing the operation.

SUMMARY OF THE INVENTION

This invention has been developed for the purpose of obviating the aforesaid disadvantages of the prior art. Accordingly, the invention has as its object the provision of a tube handling device which enables tubes to be handled readily and without any trouble or danger caused to the operator, by means of a plurality of claws.

The outstanding characteristics of the invention enabling the aforesaid object to be accomplished in a tube handling device comprising first beam means and a plurality of second beam means each supporting at one end portion thereof one or a plurality of claw means movable in a direction perpendicular to the length of the second beam means comprise claw members movable axially and having second sensor means for sensing the amount of engagement of claws with tubes while being movable to inoperative positions, and first sensor means located on the underside of the first beam means or second beams means for sensing the relative positions of the first beam means and top surfaces of the tubes. By virtue of these features, the problems the tube handling devices of the prior art are faced with can be solved, and loading and unloading of tubes can be performed with a high degree of efficiency with a minimum of labor and with great safety no matter how high the stack of tubes to be handled is while at the same time only the selected tubes in the yard are handled.

DETAILED DESCRIPTION OF THE PREFERRED EMBODIMENT

One embodiment of the invention will now be described in detail by referring to FIGS. 6–10. The tube handling device according to the invention comprises first beam means 21 hung horizontally for movement upwardly and downwardly or leftwardly and rightwardly while maintaining a horizontal posture, and a plurality of second beam means 22 each located at one of opposite ends of the first beam means 21 for movement axially thereof. As clearly seen in FIG. 10, the first beam means 21 comprises two parallel beams each substantially square in cross-sectional shape, and each second beam means 22 comprises two beams connected to each other at one end portion by a connecting beam 22*a* and each being slidably inserted in one of the two parallel beams of the first beam means 21, each second beam means 22 being substantially in the form of a square pipe in a lying position in a plan view.

Figure 9:
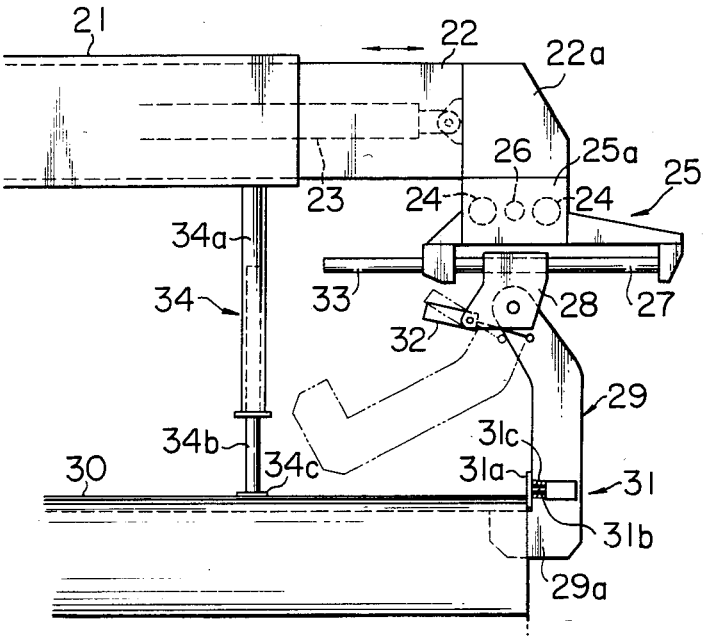
FIG. 9 is a side view of the essential portions of the tube handling device shown in FIG. 6, showing the device performing a loading operation.
Figure 10:
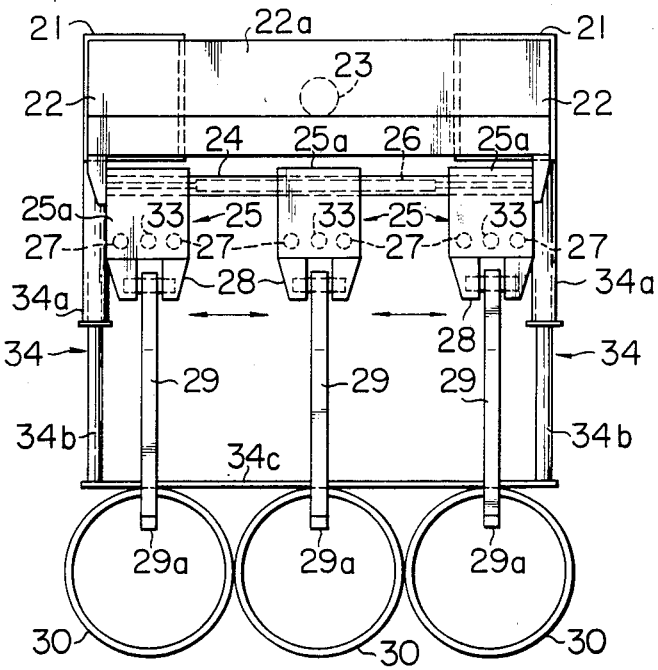
FIG. 10 is a front view of the tube handling device shown in FIG. 6.

Located between the two beams of the first beam means 21 is a first drive unit 23, which may be a hydraulic cylinder, an electric motor, etc., connected at one end thereof to the connecting beam 22*a* connecting the two beams of each second beam means 22, to enable each second beam means 22 to move relative to the first beam means 21. Two parallel rods 24 secured at opposite ends thereof to the connecting beam 22*a* extend axially of the connecting beam 22*a* below it for supporting a plurality of claw means 25 for movement along the parallel rods 24. A second drive unit 26, which may be a hydraulic cylinder, an electric motor, etc., is mounted between the rods 24 for individually driving the claw means 25 for movement axially of the rods 24. The claw means 25 each comprise a claw mounting member 25*a* supported by the rods 24, a support member 28 attached to a lower end portion of the claw mounting member 25*a* and engaging two parallel slide bars 27 for movement parallel to the axis of the second beam means 22, a claw member 29 supported at an upper end thereof by the support member 28 and having at a lower end thereof an engaging portion 29*a*, second sensor means 31 attached to the engaging portion 29*a* for sensing the position of a tube 30 as it is brought into engagement with an end edge of the tube 30, and a third drive unit 32, which may be a hydraulic cylinder, interposed between the support member 28 and the upper end of the claw member 29 for moving the claw member 29 inwardly to an inoperative position as indicated by phantom lines in FIG. 9. As shown in FIG. 9, the second sensor means 31 comprises a contacting plate 31*a* positioned against the end edge of the tube 30, a rod 31*b* located perpendicular to the contacting plate 31*a*, the contacting plate 31*a* and rod 31*b* being connected to a lower portion of the claw member 29 for sliding movement while being prevented from dislodging, a spiral spring 31*c* mounted between the contacting plate 31*a* and claw member 29, and a limit switch, not shown, actuated as the rod 31*b* moves. The support member 28 for supporting the claw member 29 is moved in sliding movement along the slide bars 27 by a fourth drive unit 33.

First sensor means 34 is located on the underside of either end portion of each of the two parallel beams of the first beam means 21. The first sensor means 34 which is operative to engage the top surface of each tube 30 to check the engaging portion 29*a* of the claw member 29 is located in a position in which it can be inserted in the tube 30. The first sensor means 34 comprises a pipe 34*a* extending downwardly from the underside of either end portion of the two beams of the first beam means 21, a rod 34*b* telescopically connected to the pipe 34*a*, and an elongated contacting bar 34*c* extending between the two first beam means perpendicularly to the length of the same. The relative positions can be sensed by the first sensor means 34 including a limit switch of a known type, like the second sensor means 31. The first sensor means 34 may alternatively be mounted on the second beam means 22.

Although not shown, the first, second, third and fourth drive units 23, 26, 32 and 33 are set with values corresponding to the length and diameter of the tubes to be handled. The first and second sensor means 34 and 31 produce signals upon sensing the relative positions of the tubes and the tube handling device, indicating that the next following operation can be performed.

Operation of the tube handling device of the aforesaid construction according to the invention will now be described. The first and second drive units 23 and 26 are actuated in accordance with the length and diameter of the tubes piled in a stack as shown in FIG. 2, to move the claw members 29 to suitable positions in a plan view. Then, the tube handling device is moved downwardly, and the first sensor means 34 sense the positions in which the engaging portions 29*a* of the claw members 29 can be inserted in opposite end portions of the tubes 30 and produce electric signals for the tube handling device to stop moving downwardly.

Thereafter, signals for moving the claw members 29 are given to the fourth drive units 33 whereupon the support members 28 move along the slide bars 27 to cause the engaging portions 29*a* of the claw members 29 to enter the end portions of the tubes 30. At this time, the second sensor means 31 located in the engaging portions 29*a* are brought into contact with the end edges of the tubes 30. When the second sensor means 31 sense the amount of engagement of the engaging portions 29*a* with the tubes 30 suitable for handling the tubes 30, the fourth drive units 33 are rendered inoperative, either automatically or by a manual operation performed by the operator, to allow loading and unloading machines including a winch and a crane to be actuated to lift the tubes 30 engaged by the claw members 29. The operation may be performed automatically by signals which would be supplied from the drive units to the sensor means.

Thus, even if the tubes 30 to be handled vary from each other in length, it is possible according to the invention to bring the engaging portions 29*a* of the claw members 29 into engagement with the end portions of the tubes 30 of different lengths by means of the fourth drive units 33 and second sensor means 31.

Depending on the loading or unloading operation to be performed, some of the tubes 30 in the stack may not be needed to be handled. When this is the case, signals are supplied to the third drive units 32 of the claw means 25 corresponding to the tubes 30 which are not required to be handled, to move the claw members 29 inwardly to the inoperative positions indicated by phantom lines in FIG. 9, to prevent the corresponding tubes 30 from being handled. The invention is not limited to moving the claw members 29 inwardly as shown in FIG. 9 when they are desired to be rendered inoperative, and the claw members 29 may be moved outwardly or, if it is allowed dimensionally, may be folded after being moved sideways.

The tube handling device of the aforesaid construction according to the invention can achieve the following effects:

(a) Even if the tubes to be handled were piled in a stack in a plurality of layers in a yard, the tube handling device is capable of performing a loading operation without requiring the presence of a bundling operator;

(b) The tube handling device is capable of handling tubes of different diameters and lengths safely without requiring the presence of a bundling operator; and (c) When there are tubes that need not be handled, the tubes desired can be readily handled without any trouble by excluding the tubes that need not be handled.

Having described a specific embodiment of our bearing, it is believed obvious that modification and variation of this invention is possible in light of the above teachings.

What is claimed is:

1. A tube handling device comprising:

first beam means located horizontally and capable of moving vertically while maintaining a horizontal posture;

a plurality of second beam means supported for axial sliding movement with respect to said first beam means;

at least one claw support member supported at each of end portions of said plurality of second beam means for movement in a direction perpendicular to the length of the second beam means;

claw members supported by said claw support members for sliding movement axially of the second beam means and pivotal movement about an axis perpendicular to the length of the second beam means;

first sensor means located on the underside of the first beam means or second beam means for sensing the relative positions of the beam means and tubes to be handled; and second sensor means attached to the claw members for sensing the horizontal relative positions of the claw members and the tubes to be handled.

2. A tube handling device as claimed in claim 1, wherein a downward movement of said first beam means automatically stops and the claw members automatically start a sliding movement with the claw support members upon the first sensor means producing signals, and the sliding movement of the claw members automatically stops upon the second sensor means producing signals.

* * * * *